US005693600A

United States Patent [19]

Hendriksen et al.

[11] Patent Number: 5,693,600

[45] Date of Patent: Dec. 2, 1997

[54] CLEANSING AGENT FOR PRINTING MACHINES AND PRESSES AND A METHOD OF CLEANING SUCH MACHINES AND PRESSES

[75] Inventors: Kåre Hendriksen, Værløse; Jens Parking, Tåstrup; Sven Haagensen, Holme-Olstrup, all of Denmark

[73] Assignee: Bruno Unger Scandinavia APS, Ishøj, Denmark

[21] Appl. No.: 503,859

[22] Filed: Jul. 18, 1995

[30] Foreign Application Priority Data

Jul. 20, 1994 [DK] Denmark ..... 0864/94

[51] Int. Cl.[6] ..... C11D 7/24; C11D 7/26; C11D 7/50

[52] U.S. Cl. ..... 510/170; 510/717; 510/411; 510/526; 134/38; 134/40

[58] Field of Search ..... 510/170, 171, 510/411, 526; 134/38, 40

[56] References Cited

U.S. PATENT DOCUMENTS

| | | | |
|---|---|---|---|
| 4,085,059 | 4/1978 | Smith et al. | 252/118 |
| 4,180,472 | 12/1979 | Mitchell et al. | 252/162 |
| 4,521,326 | 6/1985 | Seibert et al. | 252/174.21 |
| 4,707,293 | 11/1987 | Ferro | 252/174.17 |
| 4,774,017 | 9/1988 | Seibert et al. | 252/174.21 |
| 5,143,639 | 9/1992 | Krawack | 252/162 |

*Primary Examiner*—Paul Lieberman
*Assistant Examiner*—Gregory R. Delcotto
*Attorney, Agent, or Firm*—Watson Cole Stevens Davis, P.L.L.C.

[57] ABSTRACT

A cleansing agent, in particular for the cleaning of printing cylinders, rollers, blankets, plates and other parts of printing machines and presses, comprises from 90 to 60% by weight of a $C_6$–$C_{14}$, preferably $C_6$–$C_{12}$, more preferably $C_6$–$C_{10}$, most preferably $C_7$–$C_9$, hydrocarbon ester of a fatty acid of a mixture of such acids and from 10 to 40% by weight of a vegetable oil, based on the total weight of the fatty acid hydrocarbon ester and the vegetable oil in the cleansing agent. Preferably, the content of vegetable oil is about 25% by weight. Preferably, the fatty acid ester component is a 2-ethylhexyl ester of coconut ($C_8$–$C_{14}$) fatty acid and the vegetable oil is a highly refined deodorized soyabean oil.—Dirt or smear comprising particles, dust, fibers, printing ink and dye and/or greasy substances are removed from the surfaces of cylinders, rollers, blankets, plates and other parts or members of printing machines and presses, by applying to said surface a sufficient amount of the cleansing agent of the invention and allowing the cleansing agent to react with the dirt or smear on the said surface so as to dissolve, unstick, loosen or solubilize it and then remove the cleansing agent with the dissolved, unstuck, loosened or solubilized dirt or smear contained therein.

Compared to other vegetable and VOC cleansers the new cleansing agent:

has better cleansing properties, is less aggressive (swelling) to nitrile rubber components, does not penetrate the enemal or paint on those parts of the printing machines covered with such coatings, does not destroy or decompose the copying film on offset printing plates, has less tendency to dissolve plastic tubes and hoses, glue and additives in automatic washing apparatuses.

30 Claims, No Drawings

CLEANSING AGENT FOR PRINTING MACHINES AND PRESSES AND A METHOD OF CLEANING SUCH MACHINES AND PRESSES

BACKGROUND OF THE INVENTION

The present invention relates to a cleansing agent for removing particles, dust, printing ink and greasy substances from a surface, in particular a surface of a machine or apparatus or parts, components or members thereof. It also relates to a method of removing particles, dust, printing ink and greasy substances from a surface, in particular a surface of a machine or apparatus or parts, components or members thereof by using such cleansing agent.

More particularly, the invention relates to a cleansing agent for the cleaning of printing cylinders, rollers, blankets, and other parts, components and members of printing machines and presses as well as a method of cleaning printing cylinders, rollers, blankets and other parts, components and members of printing machines and presses. The present cleansing agent and method are also well suited for the cleaning of e.g., printing plates and the like.

During operation the movable components of a printing machine, whether directly involved in transferring the printing ink or dye to the paper web or sheets to be printed, such as for example the printing cylinders, rollers and blankets or plates, or acting as counter members for such components of a printing machine, will become fouled, greasy and sticky due to the accumulation of paper fibres, dust and printing ink residues. This results in a poor performance of the printing machine, and the printed symbols, pictures and images will become slurred and blurred and eventually the paper web or sheet will stick to the printing members and tear.

Therefore, in order to avoid the problems involved in operating a printing machine or press, the movable and possibly other components of such apparatus will have to be cleaned and freed from the accumulated dirt or smear from time to time. Besides, all the above ink transferring members of a printing machine or press have to be cleansed in connection with shift from one ink to another, e.g. of another color.

Some years ago the cleaning or cleansing of printing machines and presses, and in particular the movable components thereof, was effected almost exclusively by using volatile organic compounds (VOC) such as petroleum or white spirits, kerosine gasoline and other petroleum products as cleansing agent capable of dissolving and removing the accumulated dirt on the surfaces concerned.

However, such volatile organic compounds have a number of drawbacks in use, i.a. they are dangerous due to their high inflammability, they are considered hazardous to the health of human beings and to the environment, and they cause the rubber of the printing cylinders, rollers and blankets to swell and subsequently to shrink, harden and crack.

Attempts have been made to replace the VOC cleansing agents by agents based on water-containing soaps and/or other detergents. However, these attempts were not successful, partly because it proved difficult to design a water-based cleansing agent capable of effectively dissolving, taking up and carrying the printing ink or dye residues accumulated on the surfaces concerned, and partly because the soap or detergent in the cleansing agent showed a tendency to damage the rubber component of the printing members concerned, thus causing it to harden, shrink and crack. Besides, the soapy water tends to run into the fountain unit (or wetting tank) giving rise to the formation of an emulsion of water, soap and ink causing so-called "toning". The soap and/or detergent component of the cleansing agent was also harsh to the skin of the persons handling the agents when cleaning the components of the printing machines and presses.

Recently (about 1987) and more successfully an attempt was made to use cleansing agents based on vegetable oils for the purpose of cleaning printing machines, presses and their components, and many such vegetable products have been tried since then. However, even though some of the vegetable oil products were fair, others were toxicologically unacceptable, others aggressive to the cylinders, rubber blankets and rollers of the machines, and others did simply not function. Today a number of more or less satisfactory vegetable cleansing agents based on vegetable oil products, mainly fatty acid esters of different type are commercially available. Their particular advantages are:

- the toxicological load on the printing workers is reduced,
- the pollution of the environment, in particular the emission to the atmosphere, is reduced,
- fewer disorders and diseases otherwise caused by the use of volatile organic solvents will arise among the printing workers,
- the comsumption of cleansing agent is reduced by up to about 80%,
- the Rilsan® (a poly-tetrafluoroethylene product) coated cylinders, rubber rollers and blankets will obtain a longer life of performance because the vegetable oil-based cleansers do not have the same tendency to harden the rubber, in particular the nitrile rubbers, as is the case for the volatile organic solvents.

However, the commercially available vegetable oil-based cleansers hirtherto known still suffer from some drawbacks. Thus, some of the commercially available vegetable oil-based cleansers cause the cylinders, rubber rollers and blankets to become hard and glossy after use for a period of time, thereby rendering their surfaces unsuitable for transferring the printing ink or dye to the paper web or sheets to be printed, and some, in particular those based on methyl esters of fatty acids, cause the rubber plates, rollers and blankets to swell which in turn gives rise to a variation of the hardness of such components as from the point of time at which the rubber components are cleansed and to the point of time at which they are cleansed next time. This problem is serious because it makes it difficult to effect an appropriate adjustment of the said rubber component in relation to each other and to counter cylinders, rollers and blankets.

Thus, PCT/DK89/00222 published as WO 90/03419 discloses and claims an agent for removing ink from a printing machine, comprising a ($C_1$–$C_5$) alkyl ester of an aliphatic ($C_8$–$C_{22}$) monocarboxylic acid or a mixture of such esters. It also discloses a method of removing ink from a printing machine by applying such agent to the printing machine. The methyl, ethyl or isopropyl esters or mixtures thereof, and particularly the methyl ester, are stated to be the most suitable for use according to this document (vide page 4, lines 25 to 28), and in fact the methyl ester of rapeseed oil is the only one which is exemplified to be used. It is further mentioned that the agent may be a mixture comprising 50–100% by weight of a ($C_1$–$C_5$) alkyl ester of an aliphatic ($C_8$–$C_{22}$) monocarboxylic acid or a mixture of such acids, 0–50% by weight of vegetable oil and 0–10%, preferably 0.5–2% by weight of surfactant, said mixture being optionally emulgated in water in such amount that the water phase comprises up to 50%, preferably 25–35% by weight of the emulsion (page 4, lines 9–17). The vegetable oil can be soy bean oil, rapeseed oil, sunflower oil, cottonseed oil and coconut oil and mixtures thereof. However, it is stated on page 3, lines 10–11 that generally the best results are obtained by using the ester or ester mixtures alone, and indeed there is no example in the document demonstrating the production and use of such mixture of monocarboxylic acid ester or ester mixtures and a vegetable oil or mixtures thereof, nor demonstrating any particular advantage by using such ester/vegetable oil mixture as a cleansing agent for removing printing ink or the like.

SUMMARY OF THE INVENTION

However, according to the present invention it has now been found that a cleansing agent based on a mixture of higher hydrocarbon esters of fatty acids and a vegetable oil has the same advantages as the prior art vegetable oil-based or carboxylic acid ester-based cleansers but overcomes the above drawbacks of the said cleansers.

Thus, the present invention concerns a cleansing agent comprising from 90 to 60% by weight of a $C_6$–$C_{14}$, preferably $C_6$–$C_{12}$, more preferably $C_6$–$C_{10}$, most preferably $C_7$–$C_9$, hydrocarbon ester of a fatty acid or a mixture of such acids and from 10 to 40% by weight of a vegetable oil, based on the total weight of the fatty acid hydrocarbon ester and the vegetable oil in the cleansing agent.

More specifically, the present invention concerns a cleansing agent for the cleansing of printing cylinders, rollers, blankets, sheets and other parts of printing machines and presses, comprising from 90 to 60% by weight of a $C_6$–$C_{14}$, preferably $C_6$–$C_{12}$, more preferably $C_6$–$C_{10}$, most preferably $C_7$–$C_9$, hydrocarbon ester of a fatty acid or a mixture of such acids and from 10 to 40% by weight of a vegetable oil, based on the weight of the composition of fatty acid hydrocarbon ester and the vegetable oil.

The hydrocarbon moiety of the fatty acid ester can be straight or branched, saturated or unsaturated, e.g. containing one or more double or triple carbon-carbon bondings. Preferably the hydrocarbon moiety is saturated and more particularly also branched.

Also the fatty acid moiety of the fatty acid ester can be straight or branched, saturated or unsaturated containing one or more double or triple carbon-carbon bondings. Preferably the fatty acid moiety is straight and saturated, and in case of esters with a mixture of fatty acids the majority of the fatty acids in such mixture will be straight and saturated.

In principle the fatty acid moiety may stem from any fatty acid, but usually it will be an aliphatic fatty acid having a carbon chain length in the range of $C_6$–$C_{24}$. Preferably the carbon chain length will be in the range of $C_6$–$C_{22}$, more preferably in the range of $C_8$–$C_{18}$, yet more preferably $C_8$–$C_{16}$ and most preferably $C_8$–$C_{14}$. In case of esters with a mixture of fatty acids the majority of the fatty acids in such mixture will have carbon chain lengths in the above ranges but minor fractions having chain lengths outside these ranges may be present.

Preferably, the cleansing agent comprises from 85 to 65% by weight of the fatty acid hydrocarbon ester or mixture of such esters and from 15 to 35% by weight of a vegetable oil, more preferably from 80 to 70% by weight of the fatty acid hydrocarbon ester or mixture of such esters and from 20 to 30% by weight of the vegetable oil, based on the total weight of the fatty acid ester and the vegetable oil in the cleansing agent.

A particularly preferred embodiment of the cleansing agent of the invention comprises about 75% by weight of the fatty acid hydrocarbon ester or mixture of such esters and about 25% by weight of the vegetable oil, based on the total weight of the fatty acid ester and the vegetable oil in the cleansing agent.

Preferably, the fatty acid ester or mixture of such esters is a 2-ethylhexyl ester or a mixture of 2-ethylhexyl esters. More preferably, the fatty acid ester is a 2-ethylhexyl ester of a mixture of $C_8$ to $C_{14}$ fatty acids.

In a particularly preferred embodiment of the cleansing agent of the invention the fatty acid ester is a 2-ethylhexyl ester of a mixture of $C_8$ to $C_{14}$ fatty acids which is liquid at normal room temperature (20°–25° C.) and has the following characteristics:

| | |
|---|---|
| a saponification value of: | 174–184 |
| a hydroxyl value of: | <0.5 |
| a iodine value of: | <5 |
| an acid value of: | <0.3 |

More specifically and further preferred such 2-ethylhexyl ester mixture of $C_8$ to $C_{14}$ fatty acids is further characterized in having:

| | |
|---|---|
| a kinematic viscosity [$mm^2/s$] at 20° C. of about: | 7.7 |
| a kinematic viscosity [$mm^2/s$] at 40° C. of about: | 5.0 |
| a kinematic viscosity [$mm^2/s$] at 100° C. of about: | 1.8 |
| a cloud point [°C.] of: | <–32 |
| a pour point [°C.] of: | <–32 |
| an average mole mass of about: | 284 |
| a density at 20° C. [$g/cm^3$] of: | 0.859–0.860 |
| a flash point [°C.] of: | >170 |
| an evaporation loss [%] of about: | 69 |
| a gardener color index initial of: | 1 |
| a gardener color index at 200° C. of: | 1 |
| a TGA volatility [%] at 200° C. of about: | 11 |
| a TGA volatility [%] at 250° C. of about: | 68 |
| a TGA volatility [%] at 300° C. of about: | 100. |

The vegetable oil comprised by the cleansing agent of the present invention can be any suitable vegetable oil or a mixture of such oils, which is preferably liquid at room temperature (20°–25° C.) and is further characterized in having:

| | |
|---|---|
| an acid value of: | 0.2 max. |
| a saponification value of: | 190–195 |
| a iodine value (wijs) of: | 127–137 |
| a peroxide value, meq/kg of: | 0.5 max. |
| a specific gravity of: | 0.91 approx. |

In a particularly preferred embodiment of the cleansing agent of the invention the fatty acid ester component is a 2-ethylhexyl coconut fatty acid ester and the vegetable oil is a highly refined deodorized soyabean oil.

Specifically, such embodiment of the cleansing agent of the invention comprises about 75% by weight of a 2-ethylhexyl coconut fatty acid ester being characterized in having:

| | |
|---|---|
| a saponification value of: | 174–184 |
| a hydroxyl value of: | <0.5 |
| a iodine value of: | <5 |
| an acid value of: | <0.3 |
| a kinematic viscosity [$mm^2/s$] at 20° C. of about: | 7.7 |
| a kinematic viscosity [$mm^2/s$] at 40° C. of about: | 5.0 |
| a kinematic viscosity [$mm^2/s$] at 100° C. of about: | 1.8 |
| a cloud point [°C.] of: | <–32 |

-continued

| | |
|---|---|
| a pour point [°C.] of: | <-32 |
| an average mole mass of about: | 284 |
| a density at 20° C. [g/cm$^3$] of: | 0.859–0.860 |
| a flash point [°C.] of: | >170 |
| an evaporation loss [%] of about: | 69 |
| a gardener colur index initial of: | 1 |
| a gardener colur index at 200° C. of: | 1 |
| a TGA volatility [%] at 200° C. of about: | 11 |
| a TGA volatility [%] at 250° C. of about: | 68 |
| a TGA volatility [%] at 300° C. of about: | 100, |

and about 25% by weight of a highly refined deodorized soyabean oil being characterized in having:

| | |
|---|---|
| an acid value of: | 0.2 max. |
| a saponification value of: | 190–195 |
| a iodine value (wijs) of: | 127–137 |
| a peroxide value, meq/kg of: | 0.5 max. |
| a specific gravity of: | 0.91 approx, |

the noted percentages being based on the total weight of the 2-ethylhexyl coconut fatty acid ester and the highly refined deodorized soyabean oil.

Usually such cleansing agent is a clear yellow liquid at room temperature having:

- a saponification value of about 190 mg KOH/g product as determined according to ISO 3681,
- a iodine value (wijs) of about 32 g iodine/g product as determined according to ISO 3961, and
- an acid value of about 0.22 mg KOH/g product as determined according to ISO 3682.

Any saponification value can be determined according to ISO 3681 as mg KOH/g product.

The acid value can be determined according to ISO 3682 as mg KOH/g product.

The iodine vakue can be determined according to ISO 3682.

Preferably the cleansing agent of the invention has a total vapor pressure of less than 0.01 kPa at room temperature.

The cleansing agent of the invention can be prepared by mixing the fatty acid ester compound and the vegetable oil component in the appropriate proportions. Usually the mixing is effected by stirring but other mixing methods well known in the art can also be used.

Other substances than the fatty acid ester component and the vegetable oil component in the appropriate proportions may be incorporated in the cleansing agent of the invention provided such substances have no deleterious effect on the cleansing agent and/or on the benefits obtainable with the agent when used. Such substances may comprise e.g., emulsifiers corrosion inhibitors, fungicides, bacteriocides, disinfectants, antioxidants, perfumes, diluents and thickeners, but usually it is unncessary to incorporate such substances in the cleansing agent.

When used for the cleansing of printing cylinders, rollers, blankets and other components of printing machines and presses the cleansing agent of the invention is applied to the surfaces of the components concerned by spraying onto the surface, e.g. of a rotating roller, and subsequently removed with a rubber doctor, e.g. pressed against the surface of the same or a subsequent rotating roller, or with a piece of cloth, a brush or another appropriate device and subsequently removed with a firmly wrung cloth or web. However, it is essential that the cleansing agent is allowed sufficient time to react with the dirt or smear on the surfaces concerned in order to dissolve, unstick, loosen or solubilize it and take it up.

After removal of the cleansing agent the surfaces of the components concerned are wiped with a firmly wrung cloth or web pre-wetted with pure water. Rollers can be rinsed 3 to 4 times with water, optionally containing about 2% citric or tartaric acid. The water washing or rinsing eliminates any oil film and paper fibres or dust remaining on the surfaces of the cleansed components.

The cleansing agent of the invention can also be used in automatic washing apparatuses for printing rollers, rubber blankets and counter pressure members and the like using ordinary programmes designed for vegetable oil-based cleansing agents. Most suppliers of automatic washing apparatus for printing machines are capable of providing such programmes.

Thus, the present invention also comprises a method of removing dirt or smear comprising particles, dust, printing ink and dye and/or greasy substances from a surface, in particular a surface of a machine or apparatus or parts, components or members thereof, by applying to the surface a sufficient amount of the cleansing agent of the invention and allowing the cleansing agent to react with the dirt or smear on the surface so as to dissolve, unstick, loosen or solubilize it and then remove the cleansing agent with the dissolved, unstuck, loosened or solubilized dirt or smear contained therein.

In particular the present invention also comprises a method of removing dirt or smear comprising particles, dust, fibers, printing ink and dye and/or greasy substances from the surfaces of cylinders, rollers, blankets, plates and other parts or members of printing machines and presses, by applying to the surface a sufficient amount of the cleansing agent of the invention and allowing the cleansing agent to react with the dirt or smear on the surface so as to dissolve, unstick, loosen or solubilize it and then remove the cleansing agent with the dissolved, unstuck, loosened or solubilized dirt or smear contained therein.

It is essential, however, that the printing workers receive instructions about the cleansing procedures and are allowed sufficient time to practise the new cleansing method. In that case the washing procedure takes no more time than the hitherto used traditional cleansing procedures, and usually, after some time of practising, less time is consumed in the cleansing process.

The invention will be further illustrated by the following non-limiting working example.

EXAMPLE

Rilanit EHG (trade name) in an amount of 75 parts by weight was introduced into a vessel and 25 parts by weight of Shogun CT (trade name) was added. The total composition was mixed thoroughly by stirring and then stored until use. The mixed composition had the following characteristics:

viscosity of 27 cPs at 25° C.,

- a saponification value of 190 mg KOH/g product as determined according to ISO 3681,
- a iodine value (wijs) of 32 g iodine/g product as determined according to ISO 3961, and
- an acid value of 0.22 mg KOH/g product as determined according to ISO 3682.

Rilanit EHK (trade name) is a 2-ethylhexyl coconut fatty acid ester ($H_8$–$C_{14}$) having the following characteristics:

| | |
|---|---|
| a kinematic viscosity [$mm^2/s$] at 20° C. of about: | 7.7 |
| a kinematic viscosity [$mm^2/s$] at 40° C. of about: | 5.0 |
| a kinematic viscosity [$mm^2/s$] at 100° C. of about: | 1.8 |
| a cloud point [°C.] of: | <−32 |
| a pour point [°C.] of: | <−32 |
| an average mole mass of about: | 284 |
| a density at 20° C. [$g/cm^3$]of: | 0.859–0.860 |
| a flash point [°C.] of: | >170 |
| an evaporation loss [%] of about: | 69 |
| a gardener color index initial of: | 1 |
| a gardener color index at 200° C. of: | 1 |
| a TGA volatility [%] at 200° C. of about: | 11 |
| a TGA volatility [%] at 250° C. of about: | 68 |
| a TGA volatility [%] at 300° C. of about: | 100. |

Shogun CT (trade name, supplied by Aarhus Oliefabrik A/S, M. P. Bruunsgade 27, P.O. Box 60, DK-8100 Aarhus C, Denmark) is a clear yellow highly refined and deodorized soyabean oil which is liquid at room temperature and has the following characteristics:

| | |
|---|---|
| an acid value of: | 0.2 max. |
| a saponification value of: | 190–195 |
| a iodine value (wijs) of: | 127–137 |
| a peroxide value, meq/kg of: | 0.5 max. |
| a specific gravity of: | 0.91 approx. |

Effect on the Rubber Components Used in Printing Machines and Presses

The rubber component used for printing cylinders, rollers and blankets in printing machines and presses is usually either nitrile rubber or EPDM rubber.

Nitrile rubber or nitrile butadiene rubber is a copolymer mainly composed of acrylonitrile and butadiene subunits:

$$(CH(CN)—CH_2)_n—(CH_2—CH=CH—CH_2)_m$$

The butadiene makes the material elastical and heat and ozone resistant whereas the arylonitrile makes the material resistant to oil and the like.

EPDM rubber is a terpolymer of mainly ethylene (50–60%), propylene (40–55%) and a diene (2–5%). The diene is usually 1,4-hexadiene, dicyclopentadiene or ethylidene norbonene.

The behaviour of the cleansing agent of the present invention in relation to different nitrile and EPDM rubbers as compared to the behaviour of some commercially available vegetable oil-based or carboxylic acid lower hydrocarbon ester-based cleansers and conventional VOC cleansers was evaluated by carrying out experiments on specimens of rubbers of each type and different degrees shore hardness. The specimens were cylindrical tubes having an outer radius of about 2.2 cm and a thickness of 0.53–0.55 cm with a length of about 1 cm.

The particular characteristics of each rubber type used in the experiments are set forth in the following table 1.

TABLE 1

| Rubber | Dimension (cm) Outer radius (R) | Thickness (t) | Density ($g/cm^3$) | Hardness (°shore) |
|---|---|---|---|---|
| Nitrile 40° shore | 2.20 | 0.53 | 1.01 | 43 |
| Nitrile 30° shore | 2.20 | 0.54 | 0.98 | 35 |
| EPDM 80° shore | 2.20 | 0.55 | 1.29 | 85 |
| EPDM 40° shore | 2.20 | 0.58 | 1.10 | 43 |

Test procedure

A specimen of each rubber type was placed in a glass jar provided with a screw cap. The jar was filled with a particular cleansing agent so that the rubber specimen was completely immersed therein. Then the screw cap was screwed firmly on and the jar was placed in a thermostate incubator at 40° C. for 6 weeks. Then the specimens were removed and dried at 23° C. at a relative humidity of 50% in a climate room for about 4 to 6 weeks.

Each week the weight, the dimensions and the hardness (as determined with a Zvick hardness gauge) was determined for each of the specimens tested.

Test results

The following characteristics of each rubber specimen were measured and recorded during the experiments:

| | |
|---|---|
| $m_o$: | the initial weight of the rubber specimen, |
| $m^{max}$: | the maximum (in case of weight gain) or the minimum (in case of weight loss) weight of each rubber specimen measured after the immersion in the cleansing agent, |
| $m^{final}$: | the final weight of each rubber specimen measured at the end of the experiment, |
| $D_o$: | the initial outer diameter of each rubber specimen, |
| $D^{max}$: | the maximum (in case of increase) or the minimum (in case of reduction) outer diameter of each rubber specimen measured after the immersion in the cleansing agent, |
| $D^{final}$: | the final outer diameter of each rubber specimen measured at the end of the experiment, |
| $^{\circ}H_{min}$: | the minimum shore degree hardness measured for each rubber specimen during the experiment, |
| $^{\circ}H_{final}$: | the final shore degree hardness measured for each rubber specimen at the end of the experiment. |

Based on the above measurements the following calculations were made for each rubber specimen:

| | |
|---|---|
| $\frac{m^{max}}{m_0}$ : | the maximum relative weight gain or weight reduction (in case of weight loss) observed for each rubber specimen after the immersion in the cleansing agent, |
| $\frac{m^{final}}{m_0}$ : | the relative weight gain or weight reduction (in case of weight loss) observed for each rubber specimen at the end of the experiment, |
| $\frac{D^{max}}{D_0}$ : | the relative maximum outer diameter or the relative minimum outer diameter (in case of diameter reduction) observed for each rubber specimen after the immersion of the specimen in the cleansing agent, |
| $\frac{D^{final}}{D_0}$ : | the relative final outer diameter for each rubber specimen observed at the end of each experiment. |

The test results obtained for rubber specimens of nitrile-butadiene 30° shore, nitrile-butadiene 40° shore, EPDM 40° shore and EPDM 80° shore are tabulated in the following tables 2, 3, 4 and 5, respectively.

It appears from the results that the cleansing agent according to the example of the present invention has fairly balanced swelling characteristics as far as the relative maximum weight gain and the relative maximum outer diameter increase after immersion in the cleansing agent are concerned, in particular in the case of the nitrile-butadiene rubbers. However, what is more important is that there is only a small variation, if any, between the relative maximum weight and the relative final weight, between the relative maximum diameter and the relative final diameter and between the minimum shore degree hardness and the final shore degree hardness. This feature is essential because it makes it easy to maintain an appropriate adjustment of the rubber components of a printing machine or press, e.g. the printing cylinders, rollers and blankets, in relation to each other and to counter cylinders, rollers and blankets.

TABLE 2

Effect of cleansing agents on Nitrile-butadiene rubber 30° shore

| Cleansing agent | $\frac{m^{max}}{m_0}$ | $\frac{m^{final}}{m_0}$ | $\frac{D^{max}}{D_0}$ | $\frac{D^{final}}{D_0}$ | Shore $°H_{min}$ | Shore $°H_{final}$ |
|---|---|---|---|---|---|---|
| a | 1.109 | 1.085 | 1.050 | 1.027 | 25 | 25 |
| b | 1.178 | 1.102 | 1.086 | 1.045 | 20 | 22 |
| c | 1.000 | 0.909 | 1.000 | 0.955 | 30 | 35 |
| d | 1.000 | 0.898 | 1.005 | 0.978 | 30 | 35 |
| e | 1.000 | 0.911 | 1.000 | 0.968 | 29 | 36 |
| f | 1.372 | 1.179 | 1.131 | 1.068 | 14 | 15 |
| g | 1.366 | 1.225 | 1.141 | 1.082 | 15 | 15 |
| h | 1.311 | 1.259 | 1.173 | 1.141 | 20 | 20 |
| i | 1.382 | 1.255 | 1.149 | 1.100 | 13 | 14 |
| j | 1.066 | 1.065 | 1.036 | 1.036 | 25 | 27 |
| k | 1.097 | 1.094 | 1.068 | 1.041 | 23 | 24 |
| l | 1.457 | 1.195 | 1.164 | 1.068 | 13 | 14 |
| m | 1.421 | 1.269 | 1.194 | 1.106 | 12 | 13 |
| n | 1.099 | 1.017 | 1.054 | 1.005 | 25 | 27 |
| white spirit | 1.155 | 0.844 | 1.086 | 0.955 | 24 | 31 |
| kerosine | 1.025 | 0.856 | 1.086 | 0.950 | 27 | 34 |

The above symbols represent the following cleanser compositions:
a: the cleansing agent of the present example (according to the present invention),
b: mainly coconut fatty acid higher branched alkyl ester,
c: pure soyabean oil,
d,e: pure colza oil,
f: mainly colza oil methyl ester,
h,i: mainly colza or soya oil methyl ester,
j,k: mainly colza or soya oil ethyl ester and possibly some methyl ester,
l: mainly colza or soya methyl ester containing glycol ether,
m: colza or soya methyl ester containing volatile hydrocarbons,
n: synthetic cleanser containing volatile hydrocarbons.

TABLE 3

Effect of cleansing agents on Nitrile-butadiene rubber 40° shore

| Cleansing agent | $\frac{m^{max}}{m_0}$ | $\frac{m^{final}}{m_0}$ | $\frac{D^{max}}{D_0}$ | $\frac{D^{final}}{D_0}$ | Shore $°H_{min}$ | Shore $°H_{final}$ |
|---|---|---|---|---|---|---|
| a | 1.153 | 1.149 | 1.081 | 1.068 | 31 | 33 |
| b | 1.236 | 1.215 | 1.106 | 1.083 | 28 | 29 |
| c | 1.000 | 0.988 | 1.045 | 0.995 | 35 | 39 |
| d | 1.000 | 0.990 | 1.005 | 0.986 | 36 | 39 |
| e | 1.000 | 0.992 | 1.018 | 1.005 | 37 | 40 |
| f | 1.440 | 1.397 | 1.140 | 1.117 | 22 | 22 |
| g | 1.454 | 1.407 | 1.178 | 1.155 | 21 | 21 |
| h | 1.383 | 1.365 | 1.159 | 1.127 | 25 | 25 |
| i | 1.419 | 1.379 | 1.227 | 1.141 | 28 | 28 |
| j | 1.125 | 1.125 | 1.072 | 1.059 | 31 | 32 |
| k | 1.159 | 1.159 | 1.105 | 1.064 | 31 | 31 |
| l | 1.543 | 1.539 | 1.224 | 1.132 | 19 | 21 |
| m | 1.497 | 1.441 | 1.186 | 1.164 | 20 | 20 |
| n | 1.180 | 1.181 | 1.091 | 1.059 | 31 | 34 |
| white spirit | 1.211 | 0.999 | 1.096 | 1.005 | 31 | 34 |
| kerosine | 1.063 | 0.989 | 1.059 | 1.014 | 34 | 39 |

The symbols a through n represent the same cleansing compositions as indicated below table 2.

TABLE 4

Effect of cleansing agents on EPDM rubber 40° shore

| Cleansing agent | $\frac{m^{max}}{m_0}$ | $\frac{m^{final}}{m_0}$ | $\frac{D^{max}}{D_0}$ | $\frac{D^{final}}{D_0}$ | Shore $°H_{min}$ | Shore $°H_{final}$ |
|---|---|---|---|---|---|---|
| a | 1.467 | 1.444 | 1.190 | 1.190 | 20 | 20 |
| b | 1.663 | 1.623 | 1.229 | 1.206 | 17 | 17 |
| c | 1.032 | 0.992 | 1.014 | 0.991 | 32 | 34 |
| d | 1.056 | 1.021 | 1.036 | 1.005 | 31 | 32 |
| e | 1.042 | 1.007 | 1.009 | 1.009 | 32 | 32 |
| f | 1.594 | 1.326 | 1.218 | 1.150 | 13 | 15 |
| g | 1.633 | 1.347 | 1.213 | 1.109 | 12 | 12 |
| h | 1.351 | 1.246 | 1.164 | 1.105 | 15 | 15 |
| i | 1.611 | 1.326 | 1.227 | 1.105 | 10 | 13 |
| j | 1.178 | 1.072 | 1.091 | 1.027 | 25 | 28 |
| k | 1.256 | 1.191 | 1.095 | 1.068 | 17 | 18 |
| l | 1.446 | 1.295 | 1.169 | 1.105 | 11 | 12 |
| m | 1.499 | 1.328 | 1.195 | 1.118 | 16 | 16 |
| n | 2.028 | 1.773 | 1.353 | 1.281 | 10 | 11 |
| white spirit | 2.058 | 0.711 | 1.399 | 0.881 | 14 | 52 |
| kerosine | 1.794 | 0.750 | 1.318 | 0.873 | 16 | 46 |

The symbols a through n represent the same cleansing compositions as indicated below table 2.

TABLE 5

Effect of cleansing agents on EPDM rubber 80° shore

| Cleansing agent | $\frac{m^{max}}{m_0}$ | $\frac{m^{final}}{m_0}$ | $\frac{D^{max}}{D_0}$ | $\frac{D^{final}}{D_0}$ | Shore $°H_{min}$ | Shore $°H_{final}$ |
|---|---|---|---|---|---|---|
| a | 1.336 | 1.327 | 1.163 | 1.154 | 68 | 69 |
| b | 1.408 | 1.392 | 1.209 | 1.182 | 66 | 66 |
| c | 1.090 | 1.078 | 1.059 | 1.036 | 76 | 78 |
| d | 1.100 | 1.084 | 1.050 | 1.041 | 75 | 77 |
| e | 1.104 | 1.097 | 1.055 | 1.050 | 75 | 76 |
| f | 1.319 | 1.222 | 1.145 | 1.100 | 67 | 68 |
| g | 1.334 | 1.225 | 1.199 | 1.100 | 67 | 67 |
| h | 1.299 | 1.227 | 1.145 | 1.100 | 67 | 67 |
| i | 1.333 | 1.247 | 1.164 | 1.105 | 65 | 66 |
| j | 1.172 | 1.150 | 1.091 | 1.068 | 70 | 71 |
| k | 1.202 | 1.173 | 1.095 | 1.077 | 69 | 69 |
| l | 1.302 | 1.224 | 1.140 | 1.095 | 66 | 66 |
| m | 1.318 | 1.262 | 1.145 | 1.118 | 66 | 68 |
| n | 1.659 | 1.494 | 1.276 | 1.226 | 58 | 50 |
| white spirit | 1.832 | 0.988 | 1.370 | 0.991 | 56 | 85 |
| kerosine | 1.516 | 0.997 | 1.279 | 1.005 | 67 | 83 |

The symbols a through n represent the same cleansing compositions as indicated below table 2.

We claim:

1. A cleansing agent comprising from 90 to 60% by weight of a $C_6$–$C_{14}$ hydrocarbon ester of a fatty acid or a mixture of $C_6$–$C_{14}$ hydrocarbon esters of fatty acids and from 10 to 40% by weight of a vegetable oil, based on the total weight of the fatty acid hydrocarbon ester(s) and the vegetable oil in the cleansing agent.

2. A cleansing agent according to claim 1 comprising from 85 to 65% by weight of the fatty acid hydrocarbon ester or a mixture of such esters and from 15 to 35% by weight of a vegetable oil, based on the total weight of the fatty acid ester and the vegetable oil in the cleansing agent.

3. A cleansing agent according to claim 1 comprising from 80 to 70% by weight of the fatty acid hydrocarbon ester or a mixture of such esters and from 20 to 30% by weight of a vegetable oil, based on the total weight of the fatty acid ester and the vegetable oil in the cleansing agent.

4. A cleansing agent according to claim 1 comprising about 75% by weight of the fatty acid hydrocarbon ester or a mixture of such esters and about 25% by weight of a vegetable oil, based on the total weight of the fatty acid ester and the vegetable oil in the cleansing agent.

5. A cleansing agent according to clain 1, wherein the fatty acid hydrogen ester or mixture of such esters are derived from the fatty acids of a vegetable oil or fat.

6. A cleansing agent according to claim 1, wherein the fatty acid hydrocarbon ester or mixture of such esters is a 2-ethylhexyl ester or a mixture of 2-ethylhexyl esters.

7. A cleansing agent according to claim 1, wherein the fatty acide ester is a 2-ethylhexyl ester of a nixture of $C_8$ to $C_{14}$ fatty esters.

8. A cleansing agent according to claim 7, wherein the fatty acid ester, which is a 2-ethylhexyl ester of a mixture of $C_8$ to $C_{14}$ fatty acids, is liquid at normal room temperature and has the following characteristics:

| | |
|---|---|
| a saponification value of: | 174–184 |
| a hydroxyl value of: | <0.5 |
| a iodine value of: | <5 |
| an acid value of: | <0.3 |

9. A cleansing agent according to claim 1, wherein the vegetable oil is liquid at room temperature and is further characterized in having:

| | |
|---|---|
| an acid value of: | 0.2 max. |
| a saponification value of: | 190–195 |
| a iodine value (wijs) of: | 127–137 |
| a peroxide value, meq/kg of: | 0.5 max. |
| a specific gravity of: | 0.91 approx.. |

10. A cleansing agen according to claim 1, wherein the fatty acid ester component is a 2-ethylhexyl coconut fatty acid ester and the vegetable oil is a highly refined deodorized soyabean oil.

11. A cleansing agent according to claim 1, characterized in having:

a saponification value of about 190 mg KOH/g product as determined according to ISO 3681, a iodine value (wijs) of about 32 g iodine/g product as determined according to ISO 3961, and an acid value of about 0.22 mg KOH/g product as determined according to ISO 3682.

12. A cleansing agent according to claim 1, said agent having a total vapour pressure of less than 0.01 kPa at room temperature.

13. A cleansing agent for the cleansing of printing cylinders, rollers, blankets, sheets and other parts of printing machines and presses, comprising from 90 to 60% by weight of a $C_6$–$C_{14}$ hydrocarbon ester of a fatty acid or a mixture of $C_6$–$C_{14}$ hydrocarbon esters of fatty acids and from 10 to 40% by weight of a vegetable oil, based on the total weight of the fatty acid hydrocarbon ester(s) and the vegetable oil in the cleansing agent.

14. A cleansing agent according to claim 13 comprising from 85 to 65% by weight of a fatty acid hydrocarbon ester or a mixture of such esters and from 15 to 35% by weight of a vegetable oil, based on the total weight of the fatty acid ester and the vegetable oil in the cleansing agent.

15. A cleansing agent according to claim 13 comprising from 80 to 70% by weight of a fatty acid hydrocarbon ester or a mixture of such esters and from 20 to 30% by weight of a vegetable oil, based on the total weight of the fatty acid ester and the vegetable oil in the cleansing agent.

16. A cleansing agent according to claim 13 comprising about 75% by weight of a fatty acid hydrocarbon ester or a mixture of such esters and about 25% by weight of a vegetable oil, based on the total weight of the fatty acid ester and the vegetable oil in the cleansing agent.

17. A cleansing agent according to claim 13, wherein the fatty acid hydrocarbon ester or mixture of such esters are derived from the fatty acids of a vegetable oil or fat.

18. A cleansing agent according to claim 13, wherein the fatty acid ester or mixture of such esters is a 2-ethylhexyl ester or a mixture of 2-ethylhexyl esters.

19. A cleansing agent according to claim 13, wherrin the fatty acid ester is a 2ethylhexyl ester of a mixture of $C_8$ to $C_{14}$ fatty acids.

20. A cleansing agent according to claim 19, wherein the fatty acid ester, which is a 2-ethylhexyl ester of a mixture of $C_8$ $C_{14}$ fatty acids, is liquid at normal room temperature and has the following characteristics:

| | |
|---|---|
| a saponification value of: | 174–184 |
| a hydroxyl value of: | <0.5 |
| a iodine value of: | <5 |
| an acid value of: | <0.3 |
| a kinematic viscosity [$mm^2/s$] at 20° C. of about: | 7.7 |
| a kinematic viscosity [$mm^2/s$] at 40° C. of about: | 5.0 |
| a kinematic viscosity [$mm^2/s$] at 100° C. of about: | 1.8 |
| a cloud point [°C.] of: | <–32 |
| a pour point [°C.] of: | <–32 |
| an average mole mass of about: | 284 |
| a density at 20° C. [$g/cm^3$] of: | 0.859–0.860 |
| a flash point [°C.] of: | >170 |
| an evaporation loss [%] of about: | 69 |
| a gardener color index initial of: | 1 |
| a gardener color index at 200° C. | 1 |
| a TGA volatility [%] at 200° C. of about: | 11 |
| a TGA volatiliyy [%] at 250° C. of about: | 68 |
| a TGA volatility [%] at 300° C. of about: | 100. |

21. A cleansing agent according to claim 13, wherein the vegetable oil is liquid at room temperature and is further characterized in having:

| | |
|---|---|
| an acid value of: | 0.2 max. |
| a saponification value of: | 190–195 |
| a iodine value (wijs) of: | 127–137 |
| a peroxide value, meq/kg of: | 0.5 max. |
| a specific gravity of: | 0.91 approx. |

22. A cleansing agent according to claim 13, wherein the fatty acid ester component is a 2-ethylhexyl coconut fatty acid ester and the vegetable oil is a highly refined deodorized soyabean oil.

23. A cleansing agent according to claim 13, characterized in having:

a saponification value of about 190 mg KOH/g product as determined according to ISO 3681, a iodine value (wijs) of about 32 g iodine/g product as determined according to ISO 3961, and an acid value of about 0.22 mg KOH/g product as determined according to ISO 3682.

24. A cleansing agent according to claim 13, said agent having a total vapour pressure of less than 0.01 kPa at room temperature.

25. A cleansing agent according to claim 1 comprising from 90 to 60% by weight of a $C_6$–$C_{12}$ hydrocarbon ester of a fatty acid or a mixture of such $C_6$–$C_{12}$ hydrocarbon esters of fatty acids and from 10 to 40% by weight of a vegetable oil, based on the total weight of the fatty acid hydrocarbon ester(s) and the vegetable oil in the cleansing agent.

26. A cleansing agent according to claim 1 comprising from 90 to 60% by weight of a $C_6$–$C_{10}$ hydrocarbon ester of a fatty acid or a mixture of such $C_6$–$C_{10}$ hydrocarbon esters of fatty acids and from 10 to 40% by weight of a vegetable oil, based on the total weight of the fatty acid hydrocarbon ester(s) and the vegetable oil in the cleansing agent.

27. A cleansing agent according to claim 1 comprising from 90 to 60% by weight of a $C_7$–$C_9$ hydrocarbon ester of a fatty acid or a mixture of such $C_7$–$C_9$ hydrocarbon esters of fatty acids and from 10 to 40% by weight of a vegetable oil, based on the total weight of the fatty acid hydrocarbon ester(s) and the vegetable oil in the cleansing agent.

28. A cleansing agent according to claim 13 for the cleansing of printing cylinders, rollers, blankets, sheets and other parts of printing machines and presses, comprising from 90 to 60% by weight of a $C_6$–$C_{12}$ hydrocarbon ester of a fatty acid or a mixture of such $C_6$–$C_{12}$ hydrocarbon esters of fatty acids and from 10 to 40% by weight of a vegetable oil, based on the total weight of the fatty acid hydrocarbon ester(s) and the vegetable oil in the cleansing agent.

29. A cleansing agent according to claim 13 for the cleansing of printing cylinders, rollers, blankets, sheets and other parts of printing machines and presses, comprising from 90 to 60% by weight of a $C_6$–$C_{10}$ hydrocarbon ester of a fatty acid or a mixture of such $C_6$–$C_{10}$ hydrocarbon esters of fatty acids and from 10 to 40% by weight of a vegetable oil, based on the total weight of the fatty acid hydrocarbon ester(s) and the vegetable oil in the cleansing agent.

30. A cleansing agent according to claim 13 for the cleansing of printing cylinders, rollers, blankets, sheets and other parts of printing machines and presses, comprising from 90 to 60% by weight of a $C_7$–$C_9$ hydrocarbon ester of a fatty acid or a mixture of such $C_7$–$C_9$ hydrocarbon esters of fatty acids and from 10 to 40% by weight of a vegetable oil, based on the total weight of the fatty acid hydrocarbon ester(s) and the vegetable oil in the cleansing agent.

* * * * *